US010073475B2

(12) United States Patent
Chou et al.

(10) Patent No.: US 10,073,475 B2
(45) Date of Patent: Sep. 11, 2018

(54) VOLTAGE REGULATOR CIRCUIT AND CONTROL METHOD THEREFOR

(71) Applicant: Wistron Corporation, New Taipei (TW)

(72) Inventors: Ying-Tzu Chou, New Taipei (TW); Meng-Ru Tsai, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 15/435,317

(22) Filed: Feb. 17, 2017

(65) Prior Publication Data

US 2018/0120878 A1 May 3, 2018

(30) Foreign Application Priority Data

Nov. 3, 2016 (TW) ..... 105135682 A

(51) Int. Cl.
*G05F 1/10* (2006.01)
*G05F 1/575* (2006.01)

(52) U.S. Cl.
CPC ..... *G05F 1/575* (2013.01)

(58) Field of Classification Search
CPC ..... H02M 3/158; H02M 3/07; H02M 2001/0045; H02M 3/1588; Y02B 70/1466
USPC ..... 323/220–226, 280–285, 266, 267; 363/17, 53, 59, 6, 65.73–76, 123
See application file for complete search history.

(56) References Cited

U.S. PATENT DOCUMENTS 4,621,317 A * 11/1986 Kudo ..... G05B 19/05 700/18
6,326,772 B2 * 12/2001 Kusumoto ..... H02M 3/155 307/109
7,030,596 B1 * 4/2006 Salerno ..... H02M 3/158 323/282
7,812,579 B2 * 10/2010 Williams ..... H02M 3/07 323/222
8,040,118 B2 * 10/2011 Cho ..... G05F 1/573 323/273
8,542,509 B2 * 9/2013 Sagneri ..... H02M 3/158 363/69
8,890,493 B2 * 11/2014 Isik ..... H02M 3/07 307/66
9,182,769 B2 * 11/2015 Yamaguchi ..... G05F 1/468
9,547,318 B1 * 1/2017 Dwelley ..... G05F 1/462

* cited by examiner

*Primary Examiner* — Rajnikant Patel
(74) *Attorney, Agent, or Firm* — JCIPRNET

(57) ABSTRACT

A voltage regulator circuit and a control method therefor are provided. A voltage regulator circuit includes a Switching Pulse Width Modulation (PWM) voltage regulation control integrated chip (IC), a first switch, a second switch, and a voltage detector. The Switching PWM voltage regulation control IC includes a low-dropout (LDO) regulator and a PWM voltage regulator. The voltage detector detects a predetermined voltage level range of the output voltage, and generates a power good signal of the output voltage. During the startup period, the first switch is turned on, and the input voltage supplies the power source for the LDO regulator to generate a driving source required by the Switching PWM voltage regulation IC. After the startup period, the power source of the LDO regulator are switched from the input voltage to the output voltage by the first switch and the second switch.

8 Claims, 8 Drawing Sheets

VOLTAGE REGULATOR CIRCUIT AND CONTROL METHOD THEREFOR

CROSS-REFERENCE TO RELATED APPLICATION

This application claims the priority benefit of Taiwan application serial no. 105135682, filed on Nov. 3, 2016. The entirety of the above-mentioned patent application is hereby incorporated by reference herein and made a part of this specification.

BACKGROUND OF THE INVENTION

1. Field of the Invention

The invention relates to an electronic circuit technique, and particularly relates to a voltage regulator circuit and a control method for the voltage regulator circuit.

2. Description of Related Art

Recently, it has become the mainstream in the design of power circuits to apply a low-dropout regulator (LDO regulator) as a driving power in a switching pulse width modulation (PWM) voltage regulator. The LDO regulator has the advantages of low noise, small size, and low cost, and is broadly applied in the IC design of the PWM control chip in a direct current (DC) voltage regulator. The driving voltage of the PWM control chip needs to be stabilized at a predetermined level beforehand, so that voltage regulation and transistor switch control (e.g., the switch control of the metal oxide semiconductor field effect transistor (MOSFET)) in the PWM regulator may function normally. Therefore, it is common for the manufacturers of PWM control chips to adopt the LDO regulator to provide the driving power required for an internal PWM voltage regulator to drive a control circuit.

However, the input voltage source of the DC voltage regulator is normally directly adopted as the input source of the LDO regulator, but the input voltage level of the input voltage source may be as high as 24V or even higher. If the voltage value or other higher source voltages are directly adopted as the input source of the LDO regulator, the LDO regulator may have an excessive power loss due to a significant voltage different between the input and output ends of the LDO regulator. Therefore, the LDO regulator may overheat and be damaged easily, which may indirectly cause damage to the PWM control chip and make the PWM control chip no longer usable.

Besides, in some of the current designs, the output voltage of the voltage regulator is directly fed back as the input source of the LDO regulator. However, when the voltage regulator malfunctions due to overvoltage of output, the overvoltage of the output voltage may make the difference between the input and output voltages of the LDO regulator increase continuously due to continuous increase of the feedback voltage level. In the worst case, the LDO regulator may be damaged due to excessive power consumption caused by overvoltage, making the PWM control chip no longer usable. Therefore, how to reduce the voltage difference between the input and output of the LDO regulator, ensure the input source of the LDO regulator to be stable, so as not to be affected by the unexpected overvoltage that lasts, and reduce the power consumption of the LDO regulator are certainly issues that people skilled in the art should work on.

SUMMARY OF THE INVENTION

The invention provides a voltage regulator circuit and a control method for the voltage regulator circuit capable of switching a source voltage of an internal low-dropout (LDO) regulator of a switching pulse width modulation (PWM) voltage regulation control integrated chip (IC) and a regulation mechanism thereof from an input voltage at a higher level to a stable and lower voltage source, such as an input voltage at a lower level, so as to avoid power loss of the LDO regulator and prevent the PWM voltage regulation IC from being damaged due to overheating caused by an excessive voltage difference.

A voltage regulator circuit according to an embodiment of the invention includes a switching PWM regulation control IC, a first switch, a second switch, and a voltage detector. The switching PWM voltage regulation control integrated chip includes a LDO regulator and a PWM voltage regulator. The PWM voltage regulator regulates an output voltage of the voltage regulator circuit based on the input voltage and the driving voltage. The LDO regulator mainly serves to provide a driving control power required by the PWM voltage regulator and converts a higher level source voltage into the output voltage at a lower level to be the driving control power of the PWM voltage regulator. The voltage detector generates an output power good signal based on the level of the output voltage of the voltage regulator, and outputs a state of the output power good signal based on the level of the output voltage. The first switch is configured to determine whether the source voltage of the LDO regulator is switched from the input voltage at a higher level to the output voltage at a lower level or other voltage sources. During a startup period of the voltage regulator, since the output voltage is not within a designed range, the state of the output power good signal may indicate that the output voltage does not reach the stable state and control the first switch to be turned on, the first switch receives the input voltage, and an output end of the first switch is coupled to an input end of the LDO regulator to serve as an input source of the LDO regulator. After the voltage regulator is started, the voltage detector may reflect a power good state of the output voltage and turn off the first switch. Since the output voltage is in a stable state, and the first switch is turned off, the second switch is driven to be turned on. The second switch receives the output voltage. An output end of the second switch is also coupled to the input end of the LDO regulator. Accordingly, the input source of the LDO regulator is switched from the input voltage to the output voltage to supply power and reduce the voltage difference and power loss of the LDO regulator.

Based on the above, the voltage regulator circuit and the control method for the voltage regulator circuit according to the embodiments of the invention are capable of monitoring the stable state of the output voltage level by the voltage detector and generating the output power good signal, so as to switch the input source of the internal LDO regulator. When the output voltage of the voltage regulator is not within a stable range or exceeds the stable range due to output overvoltage, the input source of the LDO regulator is supplied by the input voltage at a higher level. The output voltage supplies only under the circumstance when the output voltage is within the stable range. By controlling the switch control based on the power good signal, it can be ensured that when the input source is switched to the low level output voltage source, the input source of the LDO regulator supplies power in a stable and safe stable, and is able to effectively reduce the voltage difference and power consumption.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
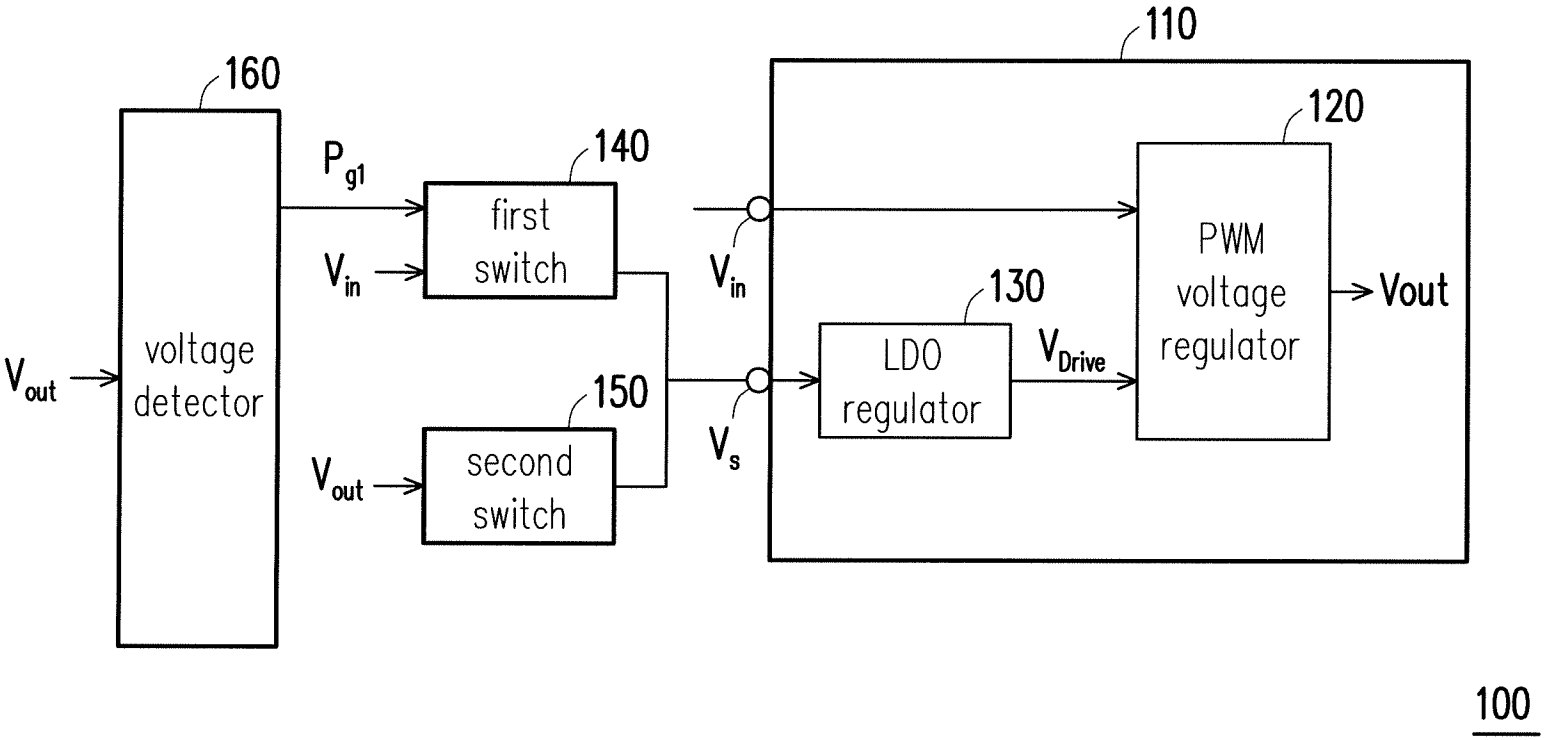
FIG. 1 is a schematic view illustrating a voltage regulator circuit according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic view illustrating a voltage regulator circuit 100 according to an embodiment of the invention. The voltage regulator circuit 100 may include a switching PWM voltage regulation control integrated chip (IC) (also referred to as voltage control integrated chip) 110, a first switch 140, a second switch 150, and a voltage detector 160. The voltage regulator circuit 100 of this embodiment is compatible with the IC design of a PWM control chip of a voltage regulator for direct current PWM in industrial application. The switching PWM voltage regulation control IC 110 includes a low-dropout (LDO) regulator 130 and a PWM voltage regulator 120. The LDO regulator 130 generates a driving power $V_{Drive}$ required by the PWM voltage regulator 120 based on an input power source $V_s$ of the LDO regulator 130. Once an input voltage $V_{in}$ and the driving power $V_{Drive}$ of the PWM voltage regulator 120 are in a stable state, the PWM voltage regulator 120 may, according to the design, perform internal PWM control and internal transistor switch control, and output a stable output voltage $V_{out}$.

The first switch 140 and the second switch 150 of the embodiment of the invention may be formed by one or a plurality of electronic components. For example, the first switch 140 and the second switch 150 may include a transistor, a diode, or a combination of the transistor and the diode, for example. In the subsequent descriptions and the embodiment of FIG. 4A, the first switch may include a single P-type transistor (M1), and the second switch 150 may include a single diode (D1). However, the embodiment of the invention is not limited thereto. Here, a possible configuration that may be put into practice is provided herein as reference. The first switch 140 receives the input voltage $V_{in}$ and an output end is coupled to an input end of the LDO regulator 130. The second switch 150 receives the output voltage $V_{out}$, and an output end of the second switch 150 is coupled to the input end of the LDO regulator 130. Assuming the output voltage $V_{out}$ to be 12V and the input voltage $V_{in}$ to be a higher voltage of 24V, for example, during a startup period of the voltage regulator circuit 100 (e.g., before a time point T0 in FIG. 3A), since the output voltage $V_{out}$ is not stable yet, namely a voltage level of the output voltage $V_{out}$ is not maintained within a predetermined voltage range of the output voltage, the voltage detector 160 may detect the voltage level of the output voltage $V_{out}$ and indicate that an output power good signal ($P_{g1}$) is in a disabled state (logic "0") suggesting that the output voltage is not stable. Since the first switch 140 of the embodiment is a P-type metal oxide semiconductor transistor, the disabled state (logic "0") of the output power good signal $P_{g1}$ may turn on the first switch 140 (transistor M1). The power source $V_s$ of the LDO regulator 130 may be nearly the same as a voltage level of the input voltage $V_{in}$ because the first switch 140 is turned on. The second switch 150 (diode D1) is reverse-biased and turned off because the output voltage $V_{out}$ is lower than a designed voltage level and the voltage level of the input voltage $V_{in}$. After the startup period, since the output voltage $V_{out}$ reaches a stable range, namely the voltage level of the output voltage $V_{out}$ is maintained within the predetermined voltage range of the output voltage, the output power good signal $P_{g1}$ indicates an enabled state (logic "1"), such that the first switch 140 (transistor M1) is turned off. Therefore, the power source $V_s$ of the LDO regulator 130 drops to lower than the output voltage $V_{out}$, and the second switch 150 (diode D1) is turned on for being turned into a forward-biased state. Therefore, the power source $V_s$ is switched to be supplied by the output voltage $V_{out}$. It should be noted that since the output voltage $V_{out}$ is generated by the voltage regulator circuit 100 based on the input voltage $V_{in}$, initial power supply time of the output voltage $V_{out}$ is later than initial power supply time of the input voltage $V_{in}$.

Figure 3A:
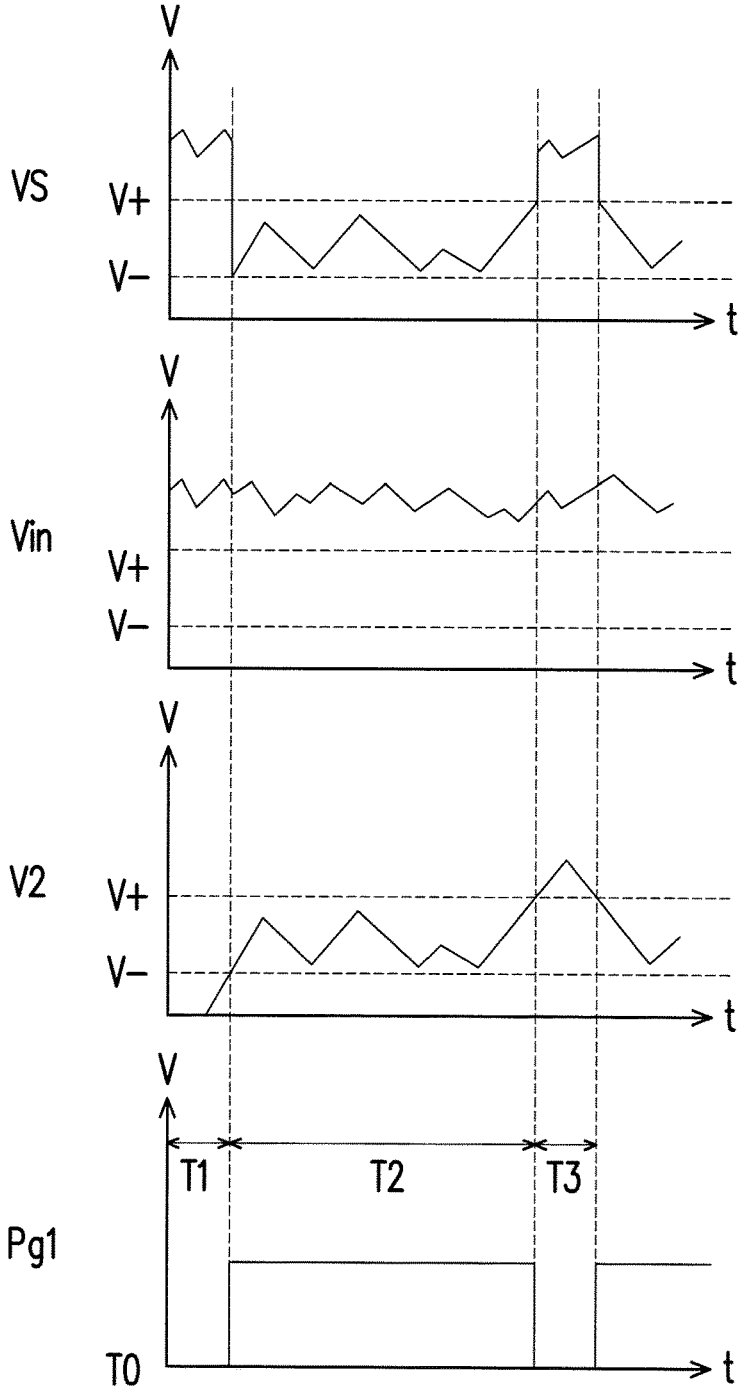
FIG. 3A is a waveform diagram of a power source, an input voltage, an output voltage, and an output power good signal of a voltage regulator circuit 100 according to an embodiment of the invention.
Figure 4A:
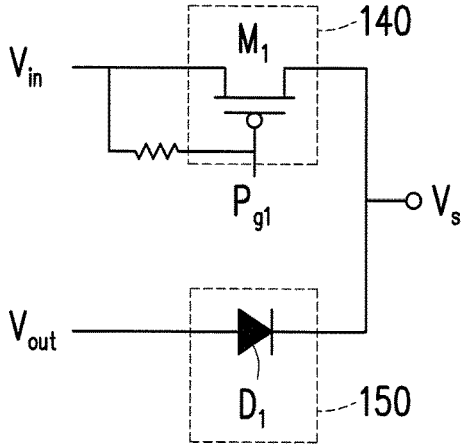
FIG. 4A is a circuit diagram illustrating a first switch and a second switch of the power regulator circuit 100 according to an embodiment of the invention.

The voltage detector 160 may be a voltage detection integrated circuit, for example. The voltage detector 160 serves to detect whether the voltage level of the output voltage $V_{out}$ stably falls within a designed range. For example, assuming that the output voltage $V_{out}$ is 12V, and the designed voltage range is +/−5%, when the voltage level of the output voltage $V_{out}$ is within a range from 11.4 V to 12.6 V, the output power good signal $P_{g1}$ indicates the enabled state (logic "1"), suggesting that the output voltage $V_{out}$ falls within the stable range. Alternatively, if the voltage level of the output voltage $V_{out}$ is not within the range, the power good signal $P_{g1}$ may indicate the disabled state (logic "0"), suggesting that the output voltage $V_{out}$ may not reach the stable range or may exceed the stable range, such as overvoltage of the output voltage $V_{out}$. As shown in FIG. 3A, during the startup period, the output voltage $V_{out}$ is rising.

However, before the output voltage $V_{out}$ rises to exceed a lower limit voltage V− of the predetermined voltage range of the output voltage, as shown in T1 in the figure, the power good signal $P_{g1}$ is in the disabled state (logic "0"), indicating that the output voltage $V_{out}$ is not stable. Therefore, the first switch 140 (transistor M1 ) is turned on, and the power source $V_s$ of the input end of the LDO regulator 130 is at a voltage level nearly the same as the voltage level of the input voltage $V_{in}$. When the output voltage $V_{out}$ stably falls within a range from V− to V+, where V+ is an upper limit voltage of the predetermined voltage range of the output voltage, the power good signal $P_{g1}$ is turned into the enabled state (logic "1"), indicating that the output voltage $V_{out}$ is stable, such as T2 in FIG. 3A. Here, the power source $V_s$ is at a voltage level nearly the same as the voltage level of the output voltage $V_{out}$. If overvoltage occurs after the output voltage $V_{out}$ becomes stable, such as T3 of FIG. 3A showing that the output voltage $V_{out}$ exceeds the upper limit voltage V+, the power good signal $P_{g1}$ is again turned into the disabled state (logic "0"), indicating that the output voltage $V_{out}$ is not stable, so as to avoid the damage caused by an excessive voltage difference due to lasting of the overvoltage of the output voltage $V_{out}$. The power good signal $P_{g1}$ is only maintained in the enabled state (logic "1") when the output voltage $V_{out}$ stably falls within the range from V− to V+.

Figure 5:
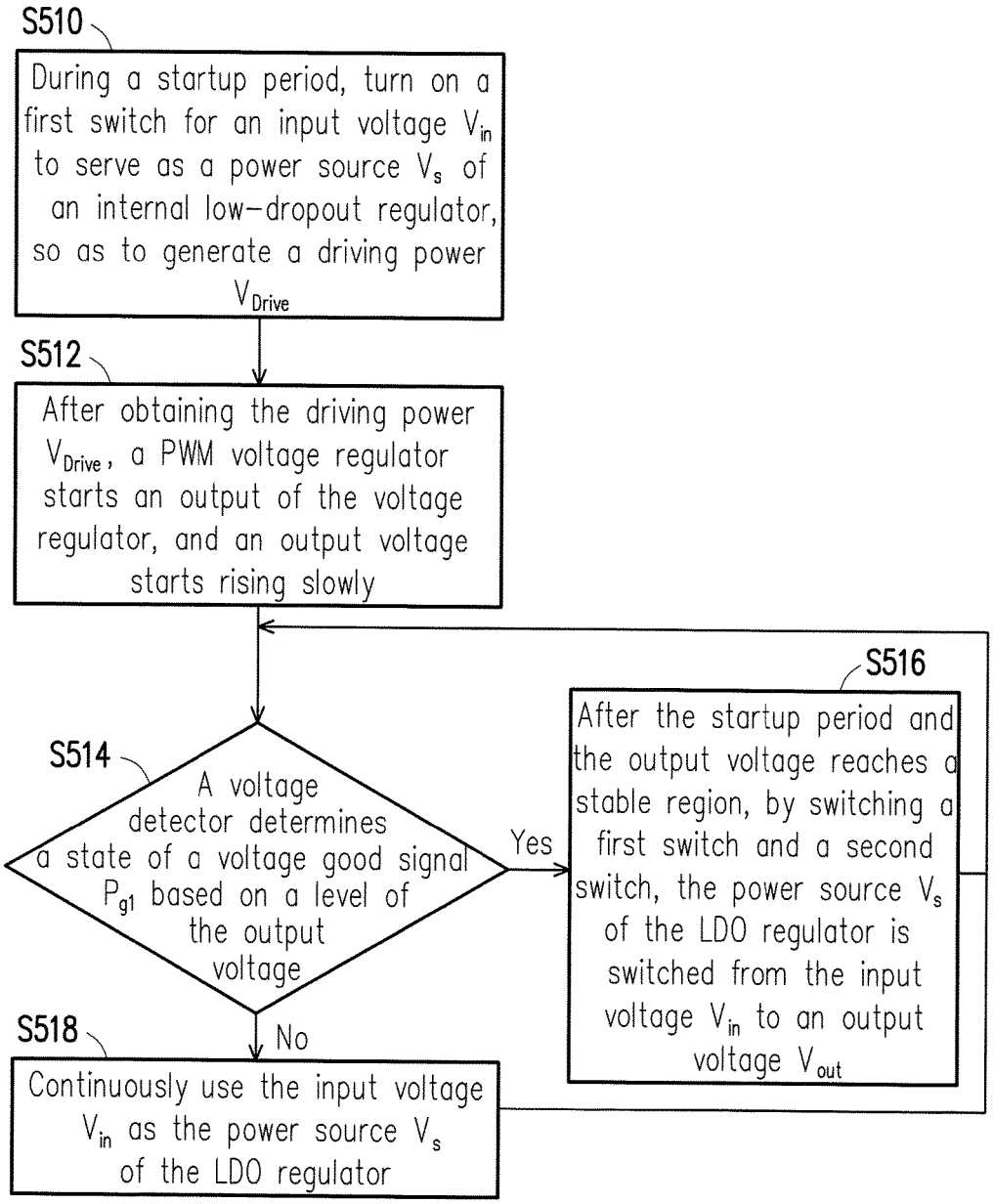
FIG. 5 is a flowchart illustrating switch control of the voltage regulator circuit 100 according to an embodiment of the invention.

FIG. 5 is a flowchart illustrating a control method for a voltage regulator circuit according to an embodiment of the invention. The steps of FIG. 5 are suitable for the voltage regulator circuit 100 of FIG. 1 and the switch circuit of FIG. 4A. Here, the descriptions are made with reference to the voltage regulator circuit 100 of FIG. 1 and the flowchart of FIG. 5. At Step S510, during the startup period of the voltage regulator circuit 100, the first switch 140 is turned on for the input voltage $V_{in}$ to serve as the power source $V_s$ of the LDO regulator 130, and the driving power $V_{Drive}$ is generated. At Step S512, after the input voltage $V_{in}$ and the driving power $V_{Drive}$ become stable, the PWM voltage regulator 120 starts the control on the PWM voltage regulator 120 and regulates the output voltage $V_{out}$ to the designed voltage level.

At Step S514, the voltage detector 160 in the voltage regulator circuit 100 determines the logic state of the output power good signal $P_{g1}$ based on the level of the output voltage $V_{out}$, and determines whether to turn on the first switch 140 based on the state. If the power good signal $P_{g1}$ is in the enabled state (logic "1"), the first switch 140 is turned off, making the voltage of the power source $V_s$ drops to drive the second switch 150 to be forward-biased and turned on, as shown in Step S516. Alternatively, if the power good signal $P_{g1}$ is in the disabled state (logic "0"), the first switch 140 is turned on, and the input voltage $V_{in}$ may continuously serve to supply power to the power source $V_s$ at the input end of the LDO regulator 130, as shown in Step S518. After the startup period, Steps S516 and S518 may form a loop. The voltage detector 160 may continuously detect the stable state of the output voltage $V_{out}$ and determine switch control on the first switch 140 and the second switch 150 based on the logic state of the power good signal $P_{g1}$.

Figure 2:
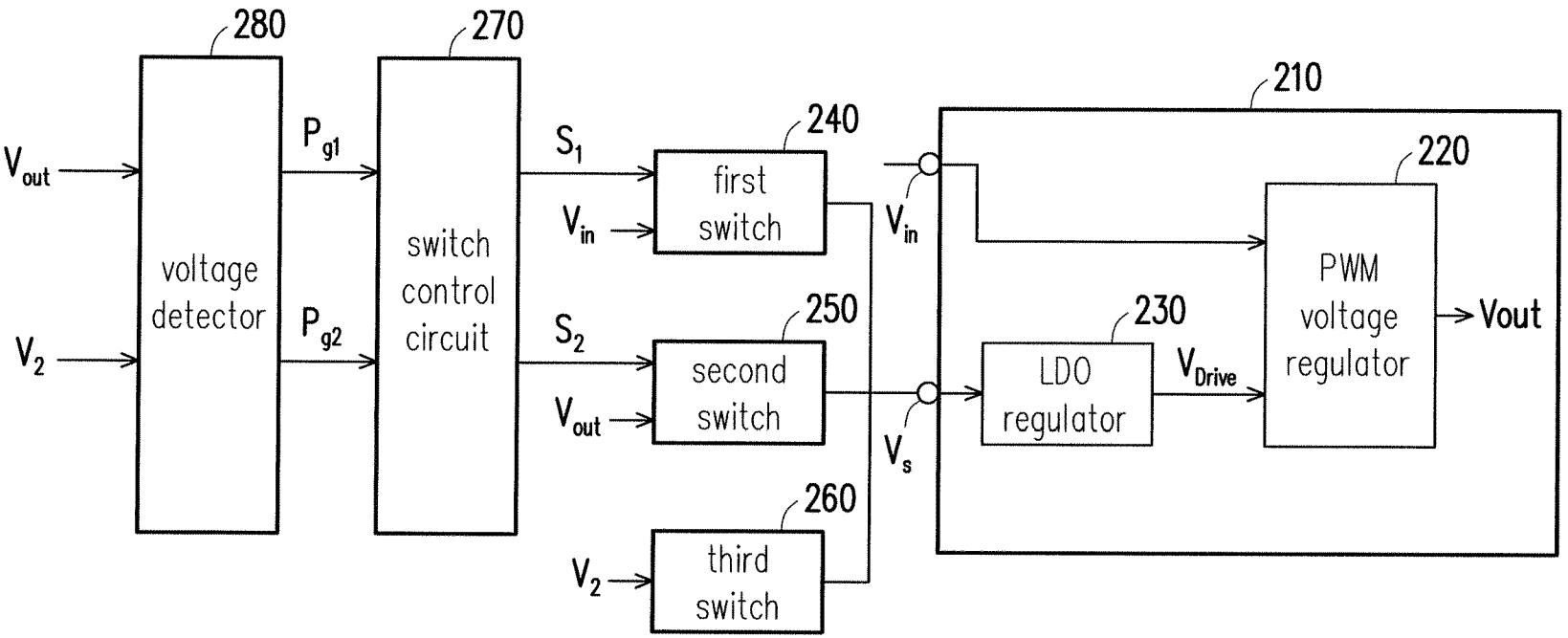
FIG. 2 is a schematic view illustrating a voltage regulator circuit according to another embodiment of the invention.

FIG. 2 is a schematic view illustrating a voltage regulator circuit 200 according to another embodiment of the invention. FIG. 2 provides a further example that a voltage difference of a LDO regulator 230 and power loss of the LDO regulator 230 are able to be effectively reduced. Here, a second voltage $V_2$ is configured as another applicable power supply voltage source of the power source $V_s$ of an input end of the LDO regulator. For example, the second voltage $V_2$ is a 6V direct current (DC) voltage source. Since the second voltage $V_2$ is at a level lower than the output voltage $V_{out}$ at 12V in the foregoing, the voltage difference of the LDO regulator 230 is able to be effectively reduced, and the power loss of the LDO regulator is able to be decreased, too.

In the embodiment of FIG. 2, the voltage regulator 200 mainly includes a switching PWM voltage regulation control integrated chip 210, a first switch 240, a second switch 250, a third switch 260, a voltage detector 280, and a switch control circuit 270. Similar to the previous embodiment, the switching PWM voltage regulation control integrated chip 210 also includes the LDO regulator 230 and a PWM voltage regulator 220. The first switch, the second switch, and the third switch may serve to switch among and choose one of the input voltage $V_{in}$, the output voltage $V_{out}$, and the second voltage $V_2$ to supply power to the power source $V_s$ of the LDO regulator 230 based on control signals $S_1$ and $S_2$. Regarding the control signals $S_1$ and $S_2$, the voltage detector 280 changes the respective power good signals $P_{g1}$ and $P_{g2}$ based on the stable states of voltage levels of the output voltage $V_{out}$ and the second voltage $V_2$. The power good signals $P_{g1}$ and $P_{g2}$ are adopted as input signals of the switch control circuit 270 to control the control signals $S_1$ and $S_2$ for switching operation.

The first switch 240, the second switch 250, and the third switch 260 of the embodiment may be formed by one or a plurality of electronic components. For example, the first switch 240, the second switch 250, and the third switch 260 may include a transistor, a diode, or a combination of the transistor and the diode, for example. In the subsequent descriptions and the embodiment of FIG. 4B, the first switch 240 and the second switch 250 may include a P-type transistor (M1 and M2), and the third switch 260 may include a single diode (D2). However, the invention is not limited thereto. Here, a possible configuration that may be put into practice is provided herein as reference. The first switch 240 receives the input voltage $V_{in}$, and an output end is coupled to an input end of the LDO regulator 230. The second switch 250 receives the output voltage $V_{out}$, and an output end of the second switch 250 is coupled to the input end of the LDO regulator 230. The third switch 260 receives the second voltage $V_2$, and an output end of the third switch 260 is also coupled to the input end of the LDO regulator 230. As an example, assuming that the output voltage $V_{out}$ is 12V, the input voltage is a higher voltage of 24V, and the second voltage $V_2$ is 6V, as shown in Table 1, during a startup period of the voltage regulator 200 (e.g., before the time point T0 in FIG. 3B), if the output voltage $V_{out}$ and the second voltage $V_2$ do not reach a stable range, namely the voltage level of the output voltage $V_{out}$ is not maintained within the predetermined voltage range of the output voltage and a voltage level of the second voltage $V_2$ is not maintained within a predetermined voltage range of the second voltage, the output power good signal ($P_{g1}$) and a second voltage power good signal ($P_{g2}$) are in the disabled state (logic "0"). Through the switch control circuit, the control signal $S_1$ indicates the disabled state (logic "0"), and the control signal $S_2$ indicates the enabled state (logic "1"), so that only the first switch 240 (transistor M 1 ) is turned on, and the power source $V_s$ of the LDP regulator 230 is supplied by the input voltage $V_{in}$. After the startup period, the output voltage $V_{out}$ reaches the stable range, namely the voltage level of the output voltage $V_{out}$ is maintained within the predetermined voltage range of the output voltage, and the output power good signal $P_{g1}$ is turned into the enabled state (logic "1"). However, under such circumstance, the voltage detector may simultaneously detect whether the second voltage is in the stable state and switch the logic state of the second voltage power good signal $P_{g2}$. Therefore, there are two possible consequences.

TABLE 1

| Pg1 | Pg2 | S1 | S2 | D2 | Note |
|---|---|---|---|---|---|
| L | L | L | H | OFF | $V_s$ supplied by $V_{in}$ |
| H | L | H | L | OFF | $V_s$ supplied by $V_{out}$ |
| X | H | H | H | ON | $V_s$ supplied by $V_2$ |

Note:
"H" stands for high level, "L" stands for low level, and "X" stands for "Don't care", and may be "H" or "L".

First, when the level of the second voltage $V_2$ does not reach the stable range, namely the voltage level of the second voltage $V_2$ is not maintained in the predetermined voltage range of the second voltage, the second voltage power good signal $P_{g2}$ may indicate the disabled state (logic "0"). Under such circumstance, the switch control circuit 270 may control the control signal $S_1$ to be in the enabled state (logic "1"), such that the first switch 240 (transistor M1) is turned off, and control the control signal $S_2$ to be in the disabled state (logic "0"), such that the second switch 250 (transistor M2) is turned on. Therefore, the power source $V_s$ of the LDO regulator 230 may be switched to be supplied by the output voltage $V_{out}$. However, since the voltage level of the output voltage $V_{out}$ is still higher than the second voltage $V_2$, the third switch 260 (D2) is still reverse-biased and turned off. Therefore, the power source $V_s$ of the LDO regulator is still supplied by the output voltage $V_{out}$.

Second, when the level of the second voltage $V_2$ reaches the stable range, namely the voltage level of the second voltage $V_2$ is maintained in the predetermined voltage range of the second voltage, the second voltage power good signal $P_{g2}$ may indicate the enabled state (logic "1"). Under such circumstance, the switch control circuit 270 may control the control signal $S_1$ to be in the enabled state (logic "1"), such that the first switch 240 (transistor M1) is turned off, and control the control signal $S_2$ to be in the enabled state (logic "1"), such that the second switch 250 (transistor M2) is turned off. When the power source $V_s$ of the LDO regulator 230 drops to lower than the second voltage $V_2$, the third switch 260 (diode D2) is switched to be forward-biased and turned on, such that the power source $V_s$ is switched to be supplied by the second voltage $V_2$.

Figure 3B:
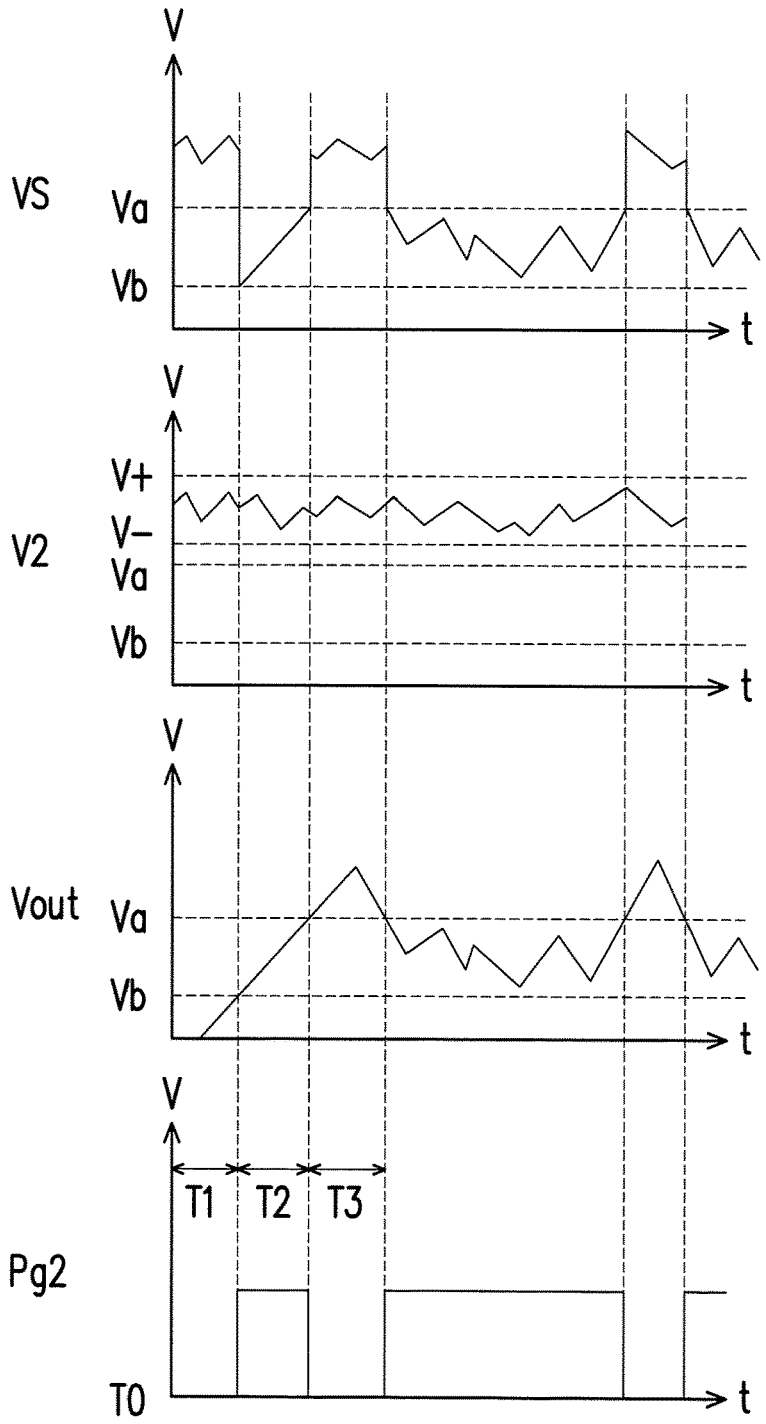
FIG. 3B is a waveform diagram of a power source, a second voltage, an output voltage, and a second voltage power good signal of a voltage regulator circuit 200 according to another embodiment of the invention.
Figure 4B:
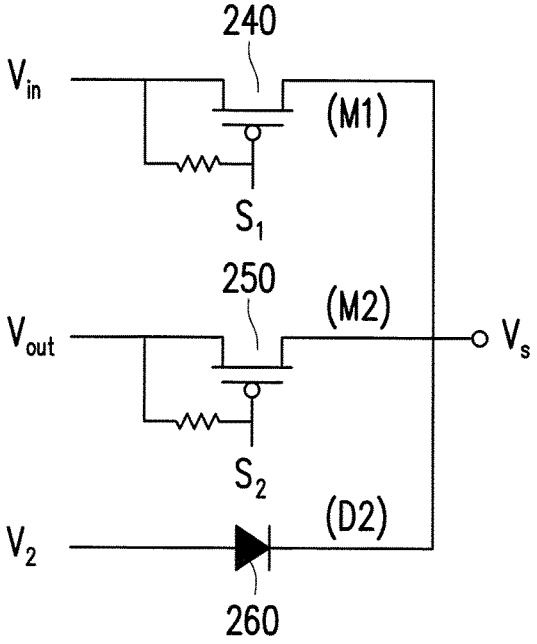
FIG. 4B is a circuit diagram illustrating a first switch, a second switch, and a third switch of the voltage regulator circuit 200 according to another embodiment of the invention.

The voltage detector 280 of the embodiment mainly serves to detect whether the voltage levels of the output voltage $V_{out}$ and the second voltage $V_2$ stably fall within designed ranges. For example, assuming that the output voltage is 12V, and the designed voltage range is +/−5%, when the voltage level of the output voltage $V_{out}$ is within a range from 11.4 V to 12.6 V, the output power good signal $P_{g1}$ indicates the enabled state (logic "1"), suggesting that the voltage level of the output voltage $V_{out}$ falls within the stable range. Also, assuming that the second voltage is 6V, and the designed voltage range is +/−5%, for example, when the voltage level of the second voltage $V_2$ is within a range from 5.7 V to 6.3 V, the second voltage power good signal $P_{g2}$ indicates the enabled state (logic "1"), suggesting that the voltage level of the second voltage $V_2$ also falls within the stable range. Alternatively, if the voltage levels are not within the stable ranges, the power good signal $P_{g1}$ or the power good signal $P_{g2}$ may indicate the disabled state (logic "0"). As shown in FIG. 3B, during the startup period, the second voltage $V_2$ is rising. However, before the second voltage $V_2$ rises to exceed a lower limit voltage Vb of the predetermined voltage range of the second voltage, as shown in T1 in the figure, the power good signal $P_{g2}$ is in the disabled state (logic "0"), indicating that the second voltage $V_2$ is not stable. Therefore, the power source $V_s$ of the LDO regulator 230 is at a voltage level nearly the same as the voltage level of the output voltage $V_{out}$. However, when the second voltage $V_2$ stably falls within a range from Vb to Va, where Va is an upper limit voltage of the predetermined voltage range of the second voltage, the power good signal $P_{g2}$ is turned into the enabled state (logic "1"), indicating that the second voltage $V_2$ is stable, such as T2 in FIG. 3B. Here, the power source $V_s$ is at a voltage level nearly the same as the voltage level of the second voltage $V_2$. If overvoltage occurs after the second voltage $V_2$ becomes stable, such as T3 of FIG. 3B showing that the second voltage $V_2$ exceeds the upper limit voltage Va, the power good signal $P_{g2}$ is again turned into the disabled state (logic "0"), indicating that the second voltage $V_2$ is not stable. Therefore, the power good signal $P_{g2}$ is only maintained in the enabled stable (logic "1") when the voltage level of the second voltage $V_2$ stably falls within the range from Vb to Va.

The switch control circuit 270 of the embodiment mainly serves to control the control signals $S_1$ and $S_2$ according to the truth table of Table 1 on the basis of the states of the power good signals $P_{g1}$ and $P_{g2}$, so as to switch the power supply voltage source of the power source $V_s$ of the LDO regulator 230. The control signal $S_1$ mainly serves to control whether the first switch 240 (transistor M1 ) is turned on or off. If the control signal $S_1$ is in the disabled state (logic "0"), the transistor M1 is turned on, indicating that the input voltage $V_{in}$ serves as the source of the power source $V_s$. The control signal $S_2$ mainly serves to control whether the second switch 250 (transistor M2) is turned on or off If the control signal $S_2$ is in the disabled state (logic "0"), the second switch 250 (transistor M2) is turned on, indicating that the output voltage $V_{out}$ serves as the source of the power source $V_s$. The control signals $S_1$ and $S_2$ in the enabled state (logic "1") indicates that the first switch 240 (transistor M1) and the second switch 250 (transistor M2) are turned off. Therefore, when the level of the power source $V_s$ drops to lower than the second voltage $V_2$, the third switch 260 (diode D2) is forward biased and turned on, indicating that the power source $V_s$ of the LDO regulator 230 is switched to be supplied by the second voltage $V_2$ at a lower level.

Figure 6A:
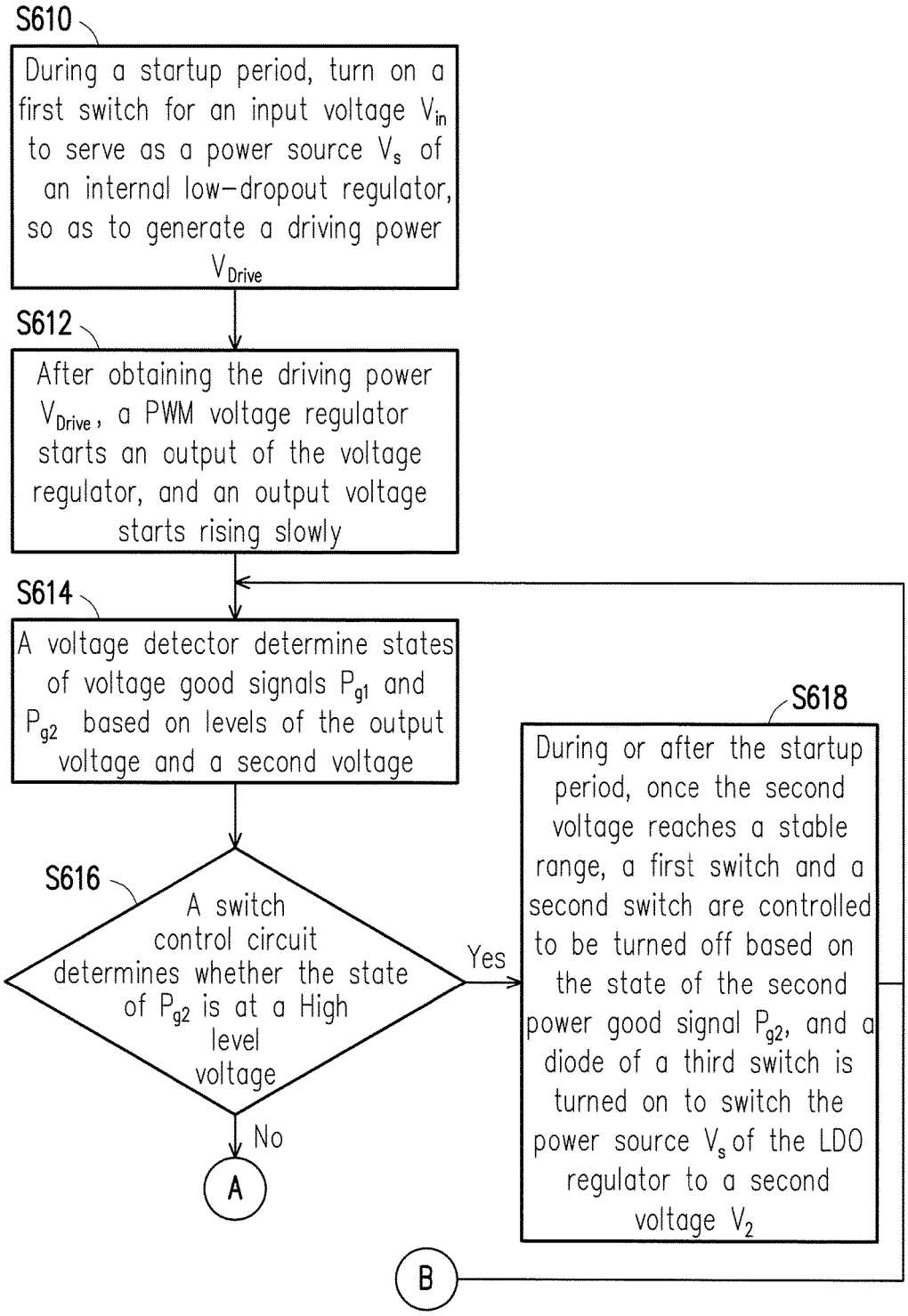
FIG. 6A and FIG. 6B are flowcharts illustrating switch control of the voltage regulator circuit 200 according to another embodiment of the invention.
Figure 6B:
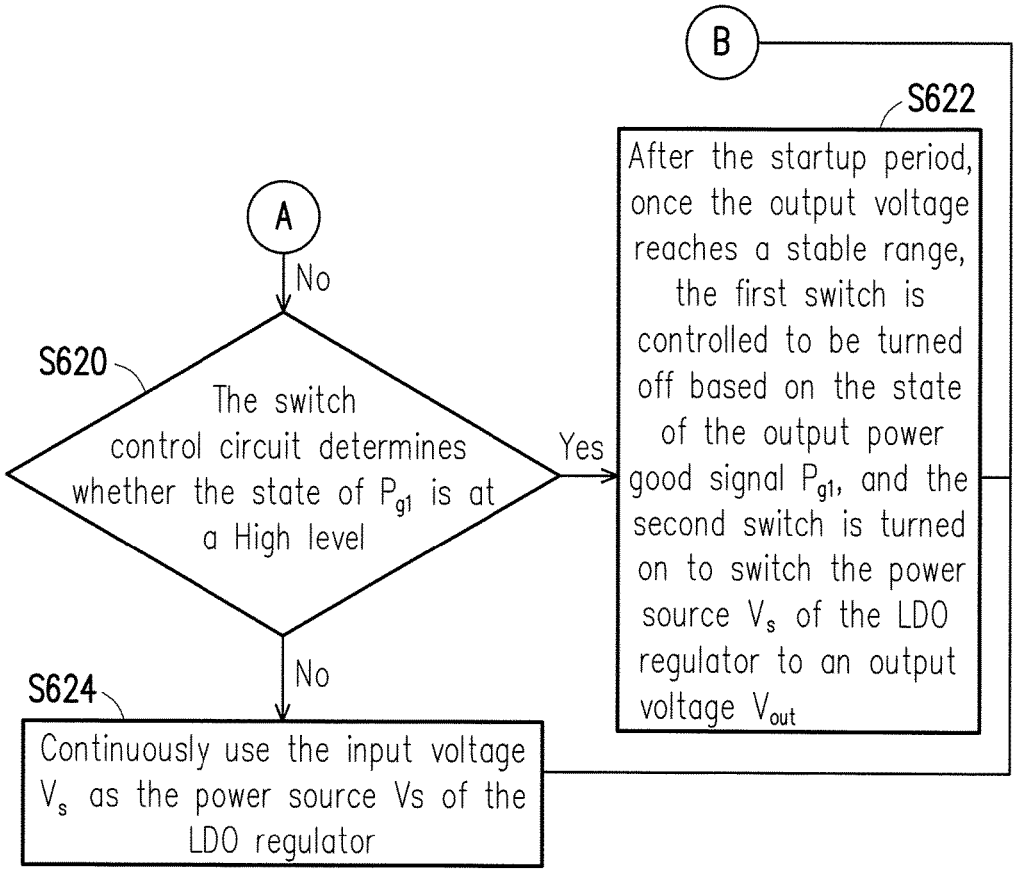

FIG. 6A and FIG. 6B are flowcharts illustrating a control method for a voltage regulator circuit according to another embodiment of the invention. The steps of FIG. 6A and FIG. 6B are suitable for the voltage regulator circuit 200 of FIG. 2 and the switch circuit of FIG. 4B. Here, the descriptions are made with reference to the voltage regulator circuit 200 of FIG. 2 and the flowcharts of FIG. 6A and FIG. 6B. At Step S610, during the startup period of the voltage regulator circuit 200, the first switch 240 is turned on for the input voltage $V_{in}$ to be the power source $V_s$ of the LDO regulator 230, and the driving power $V_{Drive}$ is generated. At Step S612, after the input voltage $V_{in}$ and the driving power $V_{Drive}$ become stable, the PWM voltage regulator 220 starts the control on the PWM voltage regulator 220 and regulate the output voltage $V_{out}$ to the designed voltage level.

At Step S614, the voltage detector 280 in the voltage regulator circuit 200 determines the logic state of the output power good signal $P_{g1}$ and the logic state of the second voltage power good signal $P_{g2}$ based on the level of the output voltage $V_{out}$ and the level of the second voltage $V_2$. At Step S616, the state of the second voltage power good signal $P_{g2}$ is determined. If the second voltage power good signal $P_{g2}$ is in the enabled state (logic "1"), the switch control circuit 270 may set the control signals $S_1$ and $S_2$ o be in the enabled state (logic "1"), such that the first switch 240 and the second switch 250 are turned off. Therefore, the diode D2 of the third switch 260 is driven to be forward-biased and turned on, indicating that the power source $V_s$ of the LDO regulator is switched to be supplied by the second voltage $V_2$.

If the second voltage power good signal $P_{g2}$ is in the disabled state (logic "0"), Step S620 is performed to determine the logic state of the output power signal $P_{g1}$. If the output power signal $P_{g1}$ is in the enabled state (logic "1"), the switch control circuit 270 may set the control signal $S_1$ to be in the enabled state (logic "1"), and set the control signal $S_2$ to be in the disabled state (logic "0"), such that the first switch 240 is turned off and the second switch 250 is turned on. Therefore, the diode D2 of the third switch is reverse-biased and turned off because the voltage level of the output voltage $V_{out}$ is higher than the voltage level of the second voltage $V_2$, indicating that the power source $V_s$ of the LDO regulator is switched to be supplied by the output voltage $V_{out}$, as in Step S622.

If it is detected that the output power good signal $P_{g1}$ is detected to be in the disabled state (logic "0") at Step S620, Step S624 is performed. The switch control circuit 270 may set the control signal $S_1$ to be in the disabled state (logic "0"), and set the control signal $S_2$ to be in the enabled state (logic "1"), such that the first switch 240 is turned on and the second switch 250 is turned off. The diode D2 of the third switch 260 is reverse-biased and turned off because the voltage level of the input voltage $V_{in}$ is higher than the voltage level of the second voltage $V_2$, indicating that the power source $V_s$ of the LDO regulator is switched to be supplied by the input voltage $V_{in}$.

After the startup period, Steps S614, S618, S622, and S624 form a loop. The voltage detector 280 may continuously detect the stable states of the output voltage $V_{out}$ and the second voltage $V_2$, and determine the switch control on the switches based on the logic states of the power good signals $P_{g1}$ and $P_{g2}$.

In view of the foregoing, the voltage regulator circuit and the method for the voltage regulator circuit according to the embodiments of the invention are able to monitor the stability of the output voltage or the voltage source having a lower voltage level in the voltage regulator circuit by the voltage detector. When the output voltage or the low-level voltage source reaches the predetermined stable state, the power good signal is generated to switch the power source of the driving power of the voltage controller to the low-level voltage source. In this way, the voltage regulator circuit is able to reduce the level of the input voltage of the LDO regulator based on the power good signal of the output voltage or the low-level voltage source, thereby keeping the driving voltage of the LDO regulator stable and reducing the power loss of and heat generated by the LDO regulator.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage regulator circuit, comprising:

a voltage regulation control integrated chip, comprising a low-dropout (LDO) regulator and a pulse width modulation (PWM) voltage regulator, wherein the LDO regulator generates a driving voltage of the PWM voltage regulator based on a power source, and the PWM voltage regulator regulates an output voltage based on an input voltage and the driving voltage;

a first switch, receiving the input voltage, wherein an output end of the first switch is coupled to an input end of the LDO regulator;

a second switch, receiving the output voltage, wherein an output end of the second switch is coupled to the input end of the LDO regulator; and a voltage detector, generating an output power good signal based on the output voltage and a predetermined voltage range of the output voltage, wherein during a startup period, the first switch is turned on and the input voltage serves as the power source of the LDO regulator, so as to generate the driving voltage required by the PWM voltage regulator, and after the startup period, the power source of the LDO regulator are switched from the input voltage to the output voltage based on the output power good signal by the first switch and the second switch, so as to reduce an input source voltage level of the LDO regulator, wherein the input voltage is greater than the output voltage.

2. The voltage regulator vehicle as claimed in claim 1, further comprising:

a switch control circuit, wherein two output ends of the switch control circuit are respectively coupled to the first switch and the second switch;

a third switch, receiving a second voltage, wherein an output end of the third switch is coupled to the input end of the LDO regulator, the voltage detector generates a second voltage power good signal based on the second voltage with reference to a predetermined voltage range of the second voltage, after the startup period, the switch control circuit receives the output power good signal and the second voltage power good signal, switches the power source of the LDO regulator from one of the input voltage and the output voltage to the second voltage by the first switch, the second switch, and the third switch based on the second voltage power good signal.

3. The voltage regulator circuit as claimed in claim 2, wherein the third switch includes one of a transistor and a diode.

4. The voltage regulator circuit as claimed in claim 1, wherein initial power supply time of the output voltage is later than initial power supply time of the input voltage.

5. The voltage regulator circuit as claimed in claim 1, wherein the first switch and the second switch include one of a transistor and a diode or a combination of the transistor and the diode.

6. A control method for a voltage regulator circuit, wherein the voltage regulator circuit comprises a first switch and a second switch, the method comprising:

during a startup period, turning on the first switch for an input voltage to serve as a power source of the voltage regulator circuit;

generating a driving voltage based on the power source;

regulating an output voltage based on the driving voltage;

generating an output power good signal based on the output voltage and a predetermined voltage range of the output voltage; and after the startup period, switching the power source from the input voltage to the output voltage by the first switch and the second switch based on the output power good signal, so as to reduce a voltage level of the power source, wherein the input voltage is greater than the output voltage.

7. The control method as claimed in claim 6, further comprising:

generating a second voltage good signal based on a second voltage with reference to a predetermined voltage range of the second voltage; and after the startup period, switching the power source from one of the input voltage and the output voltage to the second voltage based on the second voltage power good signal.

8. The control method as claimed in claim 6, wherein initial power supply time of the output voltage is later than initial power supply time of the input voltage.

* * * * *